US007312443B2

(12) United States Patent
Axelsson

(10) Patent No.: US 7,312,443 B2
(45) Date of Patent: Dec. 25, 2007

(54) REFLECTRON

(75) Inventor: Jan Axelsson, Uppsala (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 308 days.

(21) Appl. No.: 10/535,563

(22) PCT Filed: Nov. 19, 2003

(86) PCT No.: PCT/EP03/12947

§ 371 (c)(1),
(2), (4) Date: May 19, 2005

(87) PCT Pub. No.: WO2004/047141

PCT Pub. Date: Jun. 3, 2004

(65) Prior Publication Data

US 2006/0011827 A1 Jan. 19, 2006

(30) Foreign Application Priority Data

Nov. 20, 2002 (GB) ..... 0226985.0

(51) Int. Cl.
*H01J 49/40* (2006.01)

(52) U.S. Cl. ..... 250/287

(58) Field of Classification Search ..... 250/287
See application file for complete search history.

(56) References Cited

U.S. PATENT DOCUMENTS

| | | | | |
|---|---|---|---|---|
| 5,160,840 | A | 11/1992 | Vestal | |
| 5,464,985 | A | 11/1995 | Cornish et al. | |
| 5,814,813 | A | 9/1998 | Cotter et al. | |
| 6,013,913 | A | 1/2000 | Hanson | |
| 6,204,500 | B1 | 3/2001 | Whitehouse et al. | |
| 6,274,866 | B1 | 8/2001 | Li | |
| 6,365,892 | B1 | 4/2002 | Cotter et al. | |
| 6,469,295 | B1 | 10/2002 | Park | |
| 6,849,846 | B2 * | 2/2005 | Bertsch | 250/287 |

FOREIGN PATENT DOCUMENTS

| | | |
|---|---|---|
| WO | WO 01/11660 | 2/2001 |
| WO | WO 01/93308 | 12/2001 |

* cited by examiner

*Primary Examiner*—Jack I. Berman
(74) *Attorney, Agent, or Firm*—Dwayne L. Bentley; Yonggang Ji

(57) ABSTRACT

A reflectron (109) is provided with at least two sets of field resistances (131*a*-131*n*, 137*a*-137*n*) which may be connected together or separately to the reflectron electrodes (123*a*-123*n*) in order to be able to provide a plurality of different shaped electrical fields inside the reflectron (109).

5 Claims, 2 Drawing Sheets

REFLECTRON

CROSS REFREENCE TO RELATED APPLICATIONS

This application is a filing under 35 U.S.C. § 371 and claims priority to international patent application No. PCT/EP2003/012947 filed Nov. 19, 2003, published on Jun. 3, 2004 as WO 2004/047141 and also claims priority to patent application number 0226985.0 filed in Great Britain on Nov. 20, 2002; the disclosures of which are incorporated herein by reference in their entireties.

FIELD OF THE INVENTION

The present invention relates to devices and methods of the type mentioned in the preambles of the independent claims for improving the resolution and sensitivity of mass spectrometers.

PRIOR ART

Mass spectrometers can be used to determine the composition of samples. In some time-of-flight mass spectrometers (TOF MS) a sample is ionised in the first end of a mass spectrometer, the sample ions are accelerated by an electrical field towards the second end of the mass spectrometer at a certain time, then retarded and turned around by a retarding electrical field in a reflectron at the second end of the mass spectrometer and the arrival time of the sample ions at a detector mounted outside the reflectron is recorded. The time between an ion being accelerated and it being detected at the detector is known as the time of flight for the ion and is dependent on, amongst others, the length of the flight path and the mass to charge ratio of the ion. The resolution of a TOF MS is dependent on the spread of the flight times of ions of the same type. One of the main reasons for the spread of flight times is the difference in the lengths of the flight paths that the individual ions take. One of the variations in the length of the flight path is caused by the different radial positions of the ions when they are accelerated to the mass spectrometer detector surface. The sensitivity of a mass spectrometer is a function of its signal to noise levels. Once source of random noise is chemical noise. This is noise caused by ions which disintegrate after they have started to be accelerated, forming fragment ions and neutral particles of random energy. These particles have random velocities and consequently random times-of-flight. These particles cause a continuous background signal in the spectrum of signals originating from un-fragmented ions.

If a mass spectrometer is provided with a linear reflectron configuration (i.e. the resistances between the series of parallel electrodes forming the reflectron are selected so that the electrical field inside the reflectron varies linearly up the reflectron) then the energy bandwidth is small. This means that ions or particles having kinetic energies which are outside this bandwidth are not focused and consequently only in the order of 10% of the chemical noise is transferred to the detector at a peak position coinciding well with the parent ion.

If a mass spectrometer is provided with a quadratic reflectron configuration (i.e. the resistances of the series of parallel electrodes forming the reflectron are selected so that the electrical field inside the reflectron varies with a quadratic function up the reflectron) then the energy bandwidth is much larger than that of a mass spectrometer provided with a linear reflectron and in the order of 80% of the chemical noise is transferred to the detector. This means that, if everything else is unchanged, if a quadratic reflectron in a mass spectrometer is replaced by a linear reflectron then this would theoretically lead to a maximum eightfold reduction in the single spectrum signal-to-noise ratio. Statistics show the signal-to-noise ratio (S/N) can be improved by increasing the number of measurements taken—the improvement in the S/N ratio being proportional to the square root of the number of measurements taken. This means that in order to achieve an eightfold improvement in the S/N ratio to compensate for the reduction in the signal-to-noise ration caused by changing from a linear reflectron to a quadratic reflectron by increasing the number of measurements, the number of measurements made would have be 64 times the original number of measurements. Thus using a quadratic reflectron requires increased sample consumption and increased measurement times to achieve the same signal to noise ratio as a linear reflectron.

On the other band, the use of a quadratic reflectron is preferred for post source decay (PSD) mass spectrometry, i.e. mass spectrometry in which molecules are excited after ionisation so that they decay into fragments with a large energy spread during flight in the drift region of the mass spectrometer, as the high bandwidth of the quadratic reflectron allows the large energy spread to be shown on a single spectrum. A mass spectrometer equipped with a linear reflectron, with its low bandwidth, when used in PSD would require several (e.g. 10-15) spectra to be recorded at different reflectron voltages and the spectra combined to form a single spectrum corresponding to the spectrum obtained from a mass spectrometer equipped with a quadratic reflectron.

However exchanging a linear reflectron for a quadratic reflectron causes a drop in bandwidth thus the designer of a mass spectrometer has hitherto be forced to choose between designing a mass spectrometer with a high S/N ratio and narrow bandwidth or a relatively low S/N ratio and a relatively high bandwidth.

SUMMARY OF THE INVENTION

According to the present invention, at least some of the problems with the prior art are solved by means of a device having the features present in the characterising part of claim 1.

Table 1 shows an example of field resistances for forming a quadratic field inside a reflectron.

DETAILED DESCRIPTION OF EMBODIMENTS ILLUSTRATING THE INVENTION

Figure 1:
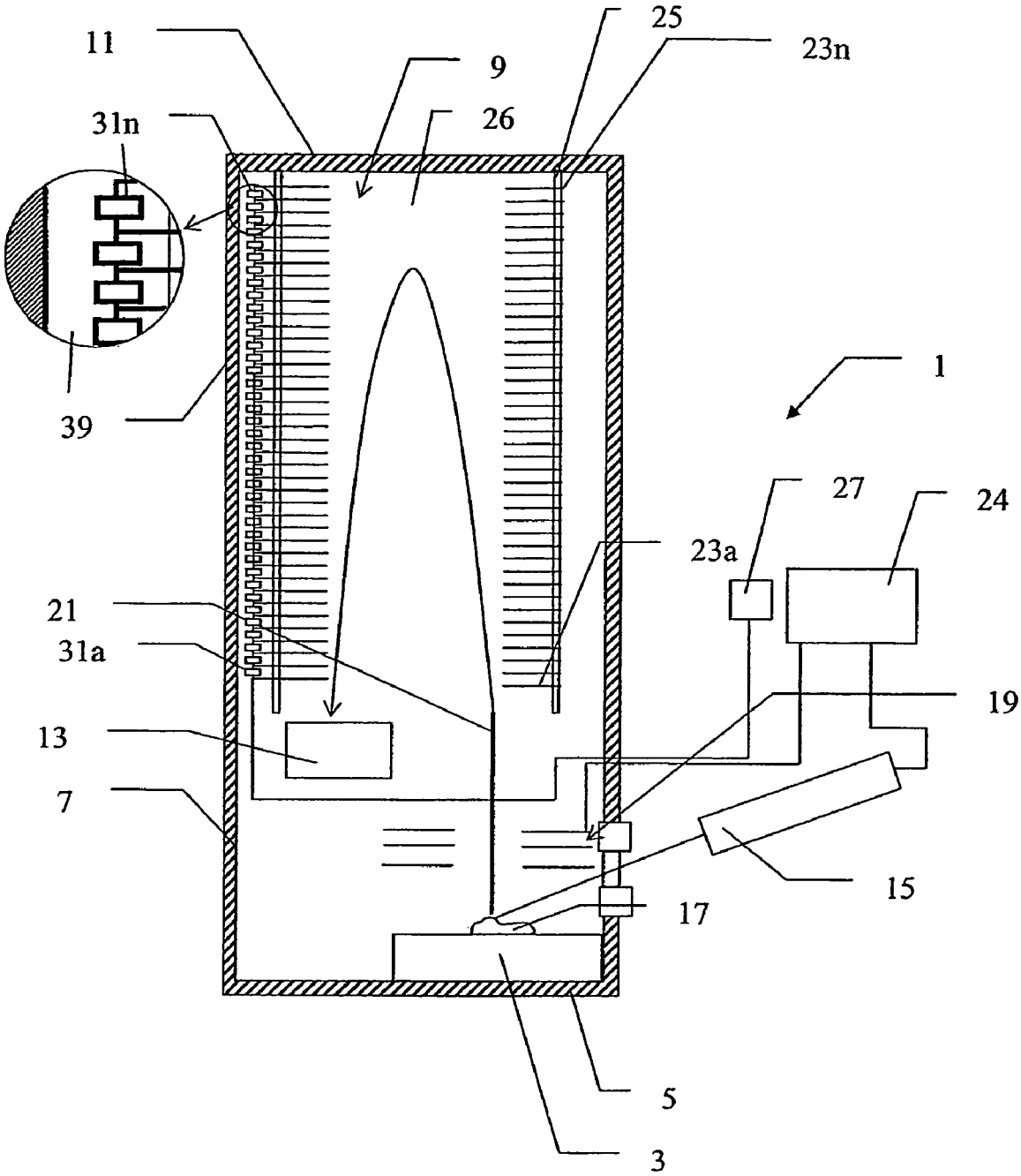
FIG. 1 shows schematically a cross-section through a prior art mass spectrometer provided with a reflectron; and, FIG. 2 shows schematically a cross-section through a mass spectrometer provided with an reflectron in accordance with a second first embodiment of the present invention.

FIG. 1 shows a simplified schematic drawing (not to scale) of a prior art time-of-flight mass spectrometer (TOF MS) 1 provided with a reflectron in which some parts of the mass spectrometer which are not related to the present invention are omitted in order to facilitate illustration of the present invention. TOF MS 1 comprises a sample plate 3 mounted at a first end 5 of a elongated casing 7, a reflectron 9 mounted in the opposite end 11 of the casing and an ion detector 13 mounted between the sample plate 3 and the exit orifice of the reflectron 9. Ionisation means e.g. a laser 15 are directed onto the sample plate 3 and can be operated to ionise a sample 17 positioned on the sample plate 3. Electrical field generating ion-accelerating means such as grid, plate or ring electrodes 19 are positioned between the sample plate 3 and the reflectron 9 and can be energised in order to accelerate ions 21 from the sample plate 3 towards the reflectron 9. Reflectron 9 comprises a series of electrodes 23*a*-23*n* mounted in parallel, spaced apart on a number of mounting rods 25, with the planes of the electrodes 23 substantially perpendicular to the longitudinal axis of the casing 7. Mounting rods 25 are insulated so that they cannot conduct electricity between the electrodes 23. The centres of electrodes 23 are open in order to form a reflectron cavity 26 into which ions can fly. Electrodes 23 are connectable to a reflectron high voltage power source 27 in order to produce an electrical field of opposite charge to the ions. This electrical field repels ions entering the central cavity, causing the ions to decelerate as they penetrate the cavity. When the high voltage power source 27 generates an electrical field over electrodes 23*a*-23*n* which is of higher voltage than the voltage applied to accelerating means 19, then as the ions progress into the cavity 25 they will slow down, stop and then reverse direction. Ion detector 13 can be arranged to produce an output signal whenever ions of sufficient energy hit its detector surface 29. Laser 15, ion-accelerating means 19 and ion detector 13 are connectable to an automated remote control means such as a computer 24 which is programmable to operate the laser 15, to energise the ion-accelerating means 19 at an appropriate time to accelerate ions 21 towards the ion detector 13, and to record the ion arrival signals from the ion detector 13.

In order to control the path of the ions in the reflectron, the electrical field in the reflectron is designed to be of a specific shape, in this example a linear field. This linear field is achieved by calculating the resistance of each electrode 23*a*-23*n* needed to shape such a field and then arranging that every electrode 23*a*-23*n* is connectable to the reflectron high voltage power source via its own field resistance 31*a*-31*n*. Each of these field resistances 31*a*-31*n* is selected to give its respective electrode 23*a*-23*n* the resistance necessary to form the desired field. For a linear field, each field resistance 31*a*-31*n* has the same value.

Figure 2:
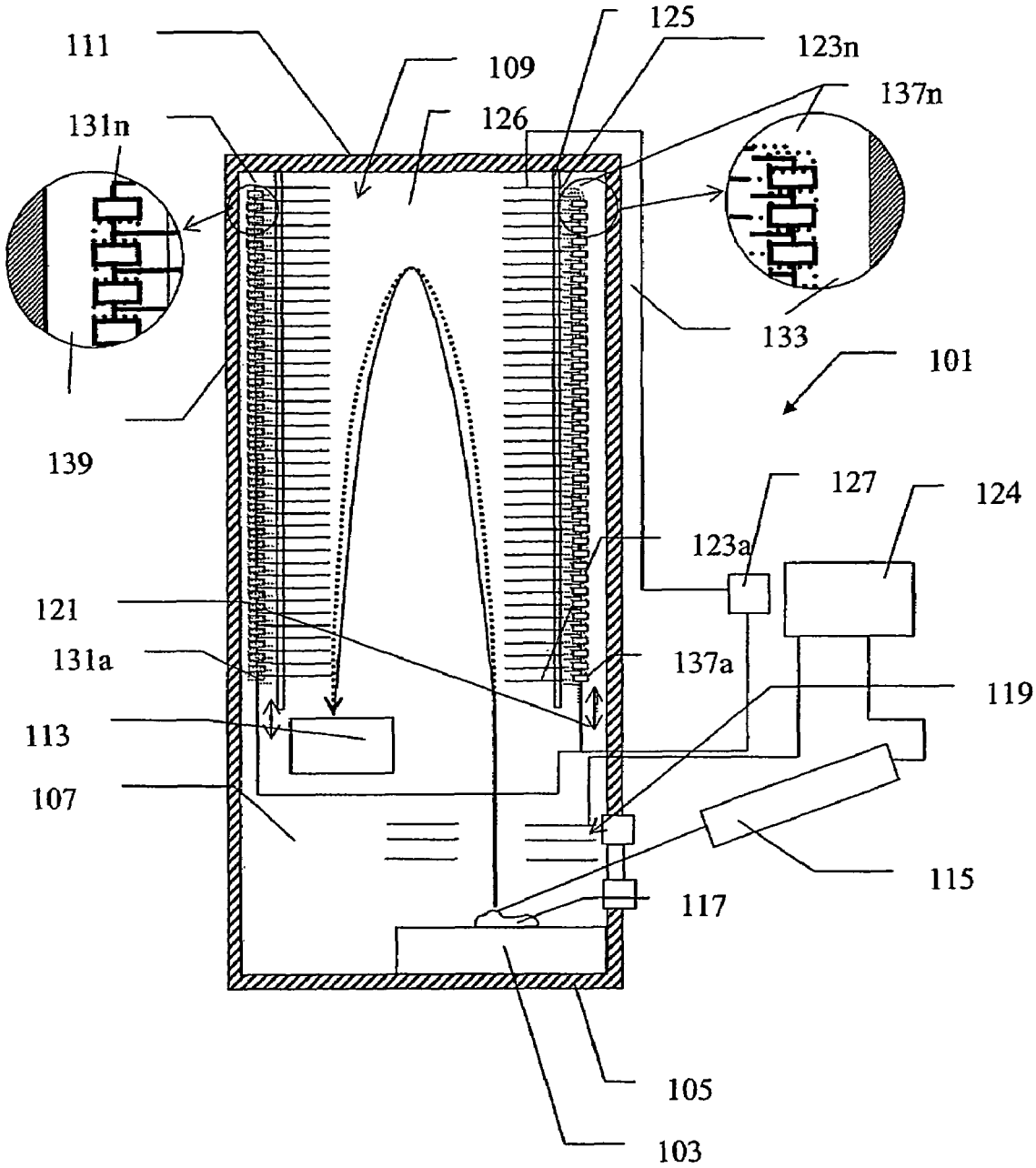

FIG. 2 shows a simplified schematic drawing (not to scale) of a time-of-flight mass spectrometer (TOF MS) 101 provided with a reflectron in accordance with the present invention in which some parts of the mass spectrometer which are not related to the present invention are omitted in order to facilitate illustration of the present invention. TOF MS 1 comprises a sample plate 103 mounted at a first end 105 of a elongated casing 107, a reflectron 109 mounted in the opposite end 111 of the casing and an ion detector 113 mounted between the sample plate 103 and the exit orifice of the reflectron 109. Ionisation means such as a laser 115 are directed onto the sample plate 103 and can be operated to ionise a sample 117 positioned on the sample plate 103. Electrical field generating ion-accelerating means such as grids or plates 119 are positioned between the sample plate 103 and the reflectron 109 and can be energised in order to accelerate ions 121 from the sample plate 103 towards the reflectron 109. Reflectron 109 comprises a series of reflectron electrodes 123*a*-123*n* mounted in parallel, spaced apart on a number of mounting rods 125, with the planes of the reflectron electrodes 123*a*-123*n* substantially perpendicular to the longitudinal axis of the casing 107. Mounting rods 125 are insulated so that they cannot conduct electricity between the reflectron electrodes 123. The centres of reflectron electrodes 123*a*-123*n* are open in order to form a reflectron cavity 126 into which ions can fly. Reflectron electrodes 123*a*-123*n* are connectable to a reflectron high voltage power source 127 in order to produce an electrical field of opposite charge to the ions. This electrical field repels ions entering the central cavity, causing the ions to decelerate as they penetrate the cavity. If the high voltage power source 127 generates an electrical field over reflectron electrodes 123*a*-123*n* which is of higher voltage than the voltage applied to accelerating means 119, then as the ions progress into the cavity 125 they will slow down, stop and then reverse direction. Ion detector 113 can be arranged to produce an output signal whenever ions of sufficient energy hit its detector surface 29. Laser 115, ion-accelerating means 119 and ion detector 113 are preferably all connected to an automated remote control means such as a computer 124 which is programmable to operate the laser 115, to energise the ion-accelerating means 119 at an appropriate time to accelerate ions 121 towards the ion detector 113, and to record the ion arrival signals from the ion detector 113.

In order to control the path of the ions in the reflectron, the electrical field in the reflectron must be of a specific shape, for example a linear field. An example of the path of an ion in a linear field is shown by a solid line in FIG. 2. This linear field is achieved by calculating the resistance of each reflectron electrode 123*a*-123*n* needed to shape such a field and then arranging that every reflectron electrode 123*a*-213*n* is connectable to the reflectron high voltage power source via its own first field resistance 131*a*-131*n*. Each of the first field resistances 131*a*-131*n* is selected to give its respective reflectron electrode 123*a*-123*n* the resistance necessary to form the desired field. Each field resistance 131*a*-131*n* may be made up of one or more electrical resistors arranged to give the desired electrical resistance. For a linear field, each first field resistance 131*a*-131*n* has the same value e.g. R ohms. In this embodiment of the present invention, first field resistances 131*a*-131*n* are connected to a first movable rod 133. Rod 133 is connectable to the high voltage power source 127 and the first field resistances 131*a*-131*n* are arranged in series on rod 133. Rod 133 is movable from a first position (shown in solid lines in FIG. 2) in which the first field resistances 131*a*-131*n* are in contact with their respective reflectron electrodes 123*a*-123*n* to a second position (shown by dotted lines in FIG. 1) in which the first field resistances 131*a*-311*n* are not in contact with their respective reflectron electrodes 123*a*-123*n*.

In order to make it possible to change the bandwidth and signal-to-noise ratio of the mass spectrometer, a mass spectrometer in accordance with the present invention is provided with means for changing the shape of the electrical field in the reflectron, for example from a linear field to a quadratic field and vice versa. In the embodiment shown in FIG. 2 this is achieved by providing two different sets of field resistances which can be connected one set at a time to the reflectron electrodes (which can be plates or grids). For example, a quadratic field can be achieved by calculating the resistance of each reflectron electrode 123*a*-123*n* needed to shape such a field and then arranging that every reflectron electrode 123*a*-213*n* is connectable to the reflectron high voltage power source via its own second field resistance 137*a*-137*n*. Each of the second field resistances 137*a*-137*n* is selected to give its respective reflectron electrode 123*a*-123*n* the resistance necessary to form the desired field. For a quadratic field, the second field resistances increase in value the further that they are from the entrance of the reflectron. Table 1 shows an example of the values of second field resistances 137*a*-137*n* which could be used to produce a quadratic field. An example of the path of an ion in a quadratic field is shown by a dotted line in FIG. 2. In this embodiment of the present invention, second field resistances 137*a*-137*n* are connected to a second movable rod 139. Rod 139 is connectable to the high voltage power source 127 and the second field resistances 137*a*-137*n* are arranged in series on rod 133. Rod 139 is movable from a first position (shown in solid lines in FIG. 1) in which the second field resistances 137*a*-137*n* are not in contact with their respective reflectron electrodes 123*a*-123*n* to a second position (shown by dotted lines in FIG. 1) in which the second field resistances 137*a*-137*n* are in contact with their respective reflectron electrodes 123*a*-123*n*.

In this embodiment of the present invention, the type of field inside the reflectron can be selected by moving rods 133 and rod 139 so that the field resistances on one rod (e.g. rod 133) are in contact with the reflectron electrodes and form part of an electrical circuit with the reflectron high voltage power source while the resistances on the other rod (e.g. rod 139) are out of contact with the reflectron electrodes and therefore do not form a complete electrical circuit and consequently do not contribute to the electrical field in the reflectron.

In a second embodiment of the present invention, each of the first and second field resistances is electrically connectable to its respective reflectron electrode by a switch. These switches may be manually or remotely switchable so that the resistance of some or all of the reflectron electrodes can be adjusted by selecting if the switches connect the first field resistances or the second field resistances to the reflectron electrodes.

In a third embodiment of the present invention, said first and second field resistances are arranged so that the resistance of some or all of the reflectron electrodes can be adjusted by arranging for them to be connectable firstly to a first set of field resistances arranged to produce a first type of field in the reflectron e.g. a linear field, and secondly to be connectable to said first set of field resistances and to be connectable simultaneously in parallel to a second set of field resistances whereby a second type of field, e.g. a quadratic field is able to be produced in the reflectron. For example, the first set of field resistances may comprise a set of substantially identical field resistances, each having a resistance e.g. R ohms, able to be individually connectable to reflectron electrodes. The second set of field resistances may have the resistances shown in Table 1 minus R ohms. In this way a quadratic field can be achieved by bringing the second set of field resistances into a parallel electrical connection with the first set of field resistances, and a linear field can be achieved by breaking the electrical circuit between the first and second sets of field resistances.

Other fields inside the reflectron may be achieved by adding third, fourth or more sets of field resistances to a reflectron. Some sets of field resistance may comprise fewer field resistances than there are reflectron electrodes, so that only a portion of the reflectron electrodes have their resistances changed and consequently only part of the electrical field inside the reflectron is changed when these sets of field resistances are connected and disconnected to the reflectron electrodes. For example, a first set of field resistances may be provided which contains at least one resistance per reflectron electrode, a second set of field resistances may be provided which contains at least one resistance per reflectron electrode, a third set of field resistances may be provided which contain at least one resistance for each of the reflectron electrodes in first portion, e.g. the half furthest away from the entrance to the reflectron, of the reflectron electrodes, and a fourth set of field resistances may be provided which contain at least one resistance for each of the reflectron electrodes in second portion, e.g. the half nearest to the entrance to the reflectron, of the reflectron electrodes. The first set of field resistances may be designed to form a linear field, the second set may be designed to form a quadratic field (either on their own or in combination with the first set), the third set may be designed to form a sharply rising linear field and the fourth set may be designed to form a less sharply rising linear field. Using only the first set of field resistances would give a linear field throughout the reflectron. Using the first set and the third set would give a first linear field which rises at a first rate in the half of the reflectron nearest to the entrance to the reflectron, and a second linear field that rises at a second rate in the half of the reflectron furthest from the entrance to the reflectron. Using just the third and fourth set would give another first linear field in the half of the reflectron nearest to the entrance to the reflectron, and another second linear field that rises at another second rate in the half of the reflectron furthest from the entrance to the reflectron.

Other combinations of field resistors and sets of field resistors are also conceivable, including connecting individual field resistors and/or sets of field resistors and/or partial sets of field resistors in series and/or in parallel.

The above mentioned embodiments are intended to illustrate the present invention and are not intended to limit the scope of protection claimed by the following claims.

What is claimed is:

1. A reflectron (109) for use in a mass spectrometer comprising:

a plurality of reflectron electrodes (123*a*-123*n*) connectable to one or more high voltage power supplies (127) wherein means for changing the electrical potentials of at least some of said reflectron electrodes (123*a*-123*n*) is provided in order to change the shape of the electrical field inside said reflectron (109); and at least two sets of field resistances (131*a*-131*n*, 137*a*-137*n*) which can be connected one set at a time, or in parallel, or in series, between the reflectron electrodes (123*a*-123*n*).

2. The reflectron of claim 1, wherein one of said sets of field resistances includes field resistances (131*a*-131*n*) arranged to produce a linear electrical field inside said reflectron (109).

3. The reflectron of claim 1, wherein one of said sets of field resistances includes field resistances (137*a*-137*n*) arranged to produce an essentially quadratic electrical field inside said reflectron (109).

4. The reflectron of claim 1, wherein at least one of said sets of different resistances includes fewer resistances than there are reflectron electrodes.

5. The reflectron of claim 1, wherein the at least two sets of field resistances (131*a*-131*n*; 137*a*-137*n*) are mounted on movable rods (133; 139), wherein each rod (133; 139) is movable between a first position where said set of field resistances (131*a*-131*n*; 137*a*-137*n*) are in electrical contact with said reflectron electrodes (123*a*-123*n*) and a second position where said set of field resistances (131*a*-131*n*; 137*a*-137*n*) is not in contact with said reflectron electrodes (123*a*-123*n*).

* * * * *